US012797713B2

(12) United States Patent
Lefebvre et al.

(10) Patent No.: US 12,797,713 B2
(45) Date of Patent: Nov. 17, 2026

(54) GOALIE BLOCKER GLOVE WITH RAMPED BLOCKER BOARD

(71) Applicant: LES EQUIPEMENTS DE GARDIEN DE BUT MICHEL LEFEBVRE ULC, Calgary (CA)

(72) Inventors: Patrick Lefebvre, Mascouche (CA); Sébastien Morin, Mascouche (CA); Maverick Charles, Mascouche (CA)

(73) Assignee: LES EQUIPEMENTS DE GARDIEN DE BUT MICHEL LEFEBVRE ULC, Calgary (CA)

( * ) Notice: Subject to any disclaimer, the term of this patent is extended or adjusted under 35 U.S.C. 154(b) by 0 days.

(21) Appl. No.: 19/098,102

(22) Filed: Apr. 2, 2025

(65) Prior Publication Data

US 2025/0387691 A1 Dec. 25, 2025

Related U.S. Application Data

(60) Provisional application No. 63/662,077, filed on Jun. 20, 2024.

(51) Int. Cl.
*A63B 71/14* (2006.01)

(52) U.S. Cl.
CPC ..... *A63B 71/143* (2013.01)

(58) Field of Classification Search
CPC ..... A63B 71/14; A63B 71/141; A63B 71/143
See application file for complete search history.

(56) References Cited

U.S. PATENT DOCUMENTS 4,700,404 A * 10/1987 Potvin ..... A63B 71/143 2/161.1
5,564,122 A * 10/1996 Wagner ..... A63B 71/143 2/161.1
5,745,916 A * 5/1998 Linner ..... A63B 71/143 2/161.1

* cited by examiner

*Primary Examiner* — Sally Haden
(74) *Attorney, Agent, or Firm* — IPHORGAN LTD.

(57) ABSTRACT

A goalie blocking glove having an inner glove with a dorsal panel and a front blocking board, further includes a ramped insert having a wedged shape supported between the dorsal panel and the front blocking board such that the primary plane of the front blocking board is non-parallel to the dorsal panel. The ramped insert defines a compound angle including a lateral slope between radial and ulnar sides of the glove and a longitudinal slope from a distal end to a proximal end of the inner glove. The ramped insert optimizes orientation of the majority of the front blocking board to be more perpendicular to oncoming pucks while the goalie assumes a more natural position, while providing better control in redirecting pucks off of the front blocking board.

11 Claims, 6 Drawing Sheets

GOALIE BLOCKER GLOVE WITH RAMPED BLOCKER BOARD

This application claims the benefit under 35 U.S.C.119(e) of U.S. provisional application Ser. No. 63/662,077, filed June 2024.

FIELD OF THE INVENTION

The present invention relates to a goalie blocker glove of the type used in the sport of ice hockey in which the goalie blocker glove has an inner glove to receive a hand of the user therein and a front blocking board supported on a dorsal side of the inner glove.

BACKGROUND

In the sport of ice hockey, the goalie protecting each net wears a catching glove on one hand and a blocker glove in the other hand that is used to hold their stick. The goalie blocker glove typically includes an inner glove at a rear side for receiving the hand of the goalie therein and a front blocking board supported at the dorsal side of the inner glove to protect the stick holding hand of the goalie from impacts. In a natural posture of the goalie, the front blocking board is typically sloped upwardly and rearwardly which can lead to undesirable redirections of impacting pucks rearwardly over the goalie.

In an attempt to redirect pucks laterally and away from the net that the goalie is protecting, many goalie blocker gloves are provided with an angled upper portion as described in U.S. Pat. No. 5,564,122. However, the angled upper portion is limited in size relative to the overall surface area of the blocking board so that the majority of the front blocking board remains sloped upwardly and rearwardly in a manner that can redirect pucks rearwardly over the goalie.

SUMMARY OF THE INVENTION

According to one aspect of the invention there is provided a goalie blocking glove comprising:

- an inner glove to receive a hand of a user therein and including a dorsal panel for spanning a dorsal side of the hand;
- a front blocking board coupled to the inner glove to protect the dorsal side of the hand, the front blocking board being elongated in length in a longitudinal direction and having a width transverse to the length in a lateral direction, and the front blocking board including a primary board section occupying a majority of front blocking board and defining a primary plane of the front blocking board;
- a ramped insert having a wedge shape, the ramped insert being supported between the dorsal panel of the inner glove and front blocking board such that the primary plane of the front blocking board is non-parallel to the dorsal panel. In the preferred embodiment, an exterior surface of the ramped insert adjacent the front blocking board is sloped relative to an interior surface of the ramped insert adjacent at a compound angle comprising both (i) a lateral slope in which the ramped insert increases in thickness in the lateral direction from a radial side to an ulnar side of the inner glove and (ii) a longitudinal slope in which the ramped insert increases in thickness in the longitudinal direction from distal end to a proximal end of the inner glove.

The use of a ramped insert forming a wedge shape between the inner glove and the front blocking board in a goalie blocker glove acts to better orient the majority of the front blocking board more perpendicular to oncoming pucks being aimed at the net that the goalie is protecting. This results in a more natural position for the front exterior face of the front blocker board facing oncoming pucks which minimizes risk movements required by the goalie during a game in maximizing the coverage area of the front blocking glove. The orientation of the front blocking board relative to the inner glove resulting from the ramped insert may also provide the goalie with better control to the direction that pucks are redirected from the front blocking board. This in turn minimizes undesirable deflections of pucks off of the goalie blocker glove that can lead directly to goals scored on the net or to rebounds that subsequently lead to goals scored on the net.

The ramped insert may form the wedged shape in the lateral direction. More particularly, the ramped insert increases in thickness in the lateral direction from a radial side to an ulnar side of the inner glove.

According to preferred embodiments, an exterior surface of the ramped insert adjacent the front blocking board is sloped in the lateral direction relative to an interior surface of the ramped insert adjacent the inner glove at an angle in the range of 4 degrees to 12 degrees.

The ramped insert may form the wedged shape in the longitudinal direction. More particularly, the ramped insert may increase in thickness in the longitudinal direction from distal end to a proximal end of the inner glove.

According to preferred embodiments, an exterior surface of the ramped insert adjacent the front blocking board is sloped in the longitudinal direction relative to an interior surface of the ramped insert adjacent the inner glove at an angle in the range of 5 degrees to 15 degrees.

The ramped insert may further include a proximal end portion which is longitudinally tapered towards a proximal end of the front blocking board.

In the illustrated embodiment, an exterior surface of the ramped insert adjacent the front blocking board is sloped relative to an interior surface of the ramped insert at a compound angle comprising both (i) a lateral slope in which the ramped insert increases in thickness in the lateral direction from a radial side to an ulnar side of the inner glove and (ii) a longitudinal slope in which the ramped insert increases in thickness in the longitudinal direction from distal end to a proximal end of the inner glove.

When the front blocking board includes an angled board section at a proximal end of the front blocking board which is angularly offset from the primary board section at the distal end of the front blocking board, the ramped insert may comprise an interior surface supported against the inner glove and an exterior surface opposite from the interior surface so as to be supported against the front blocking board, in which the exterior surface includes first and second surface portions which are angularly offset from one another such that the first and second surface portions align with the primary board section and the angled board section respectively.

The ramped insert is preferably formed of a resilient material.

According to one embodiment, the ramped insert may be formed of a porous lattice structure.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 2:
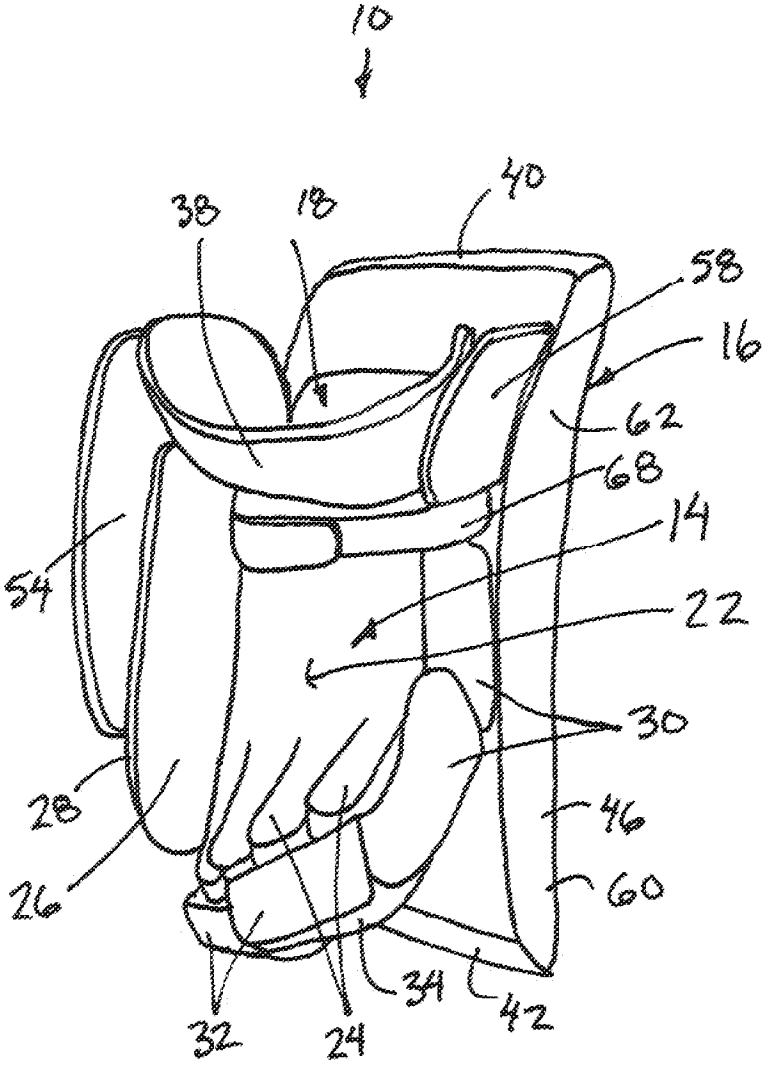
FIG. 2 is a perspective view of an inner glove at the rear of the goalie blocker glove according to FIG. 1.
Figure 1:
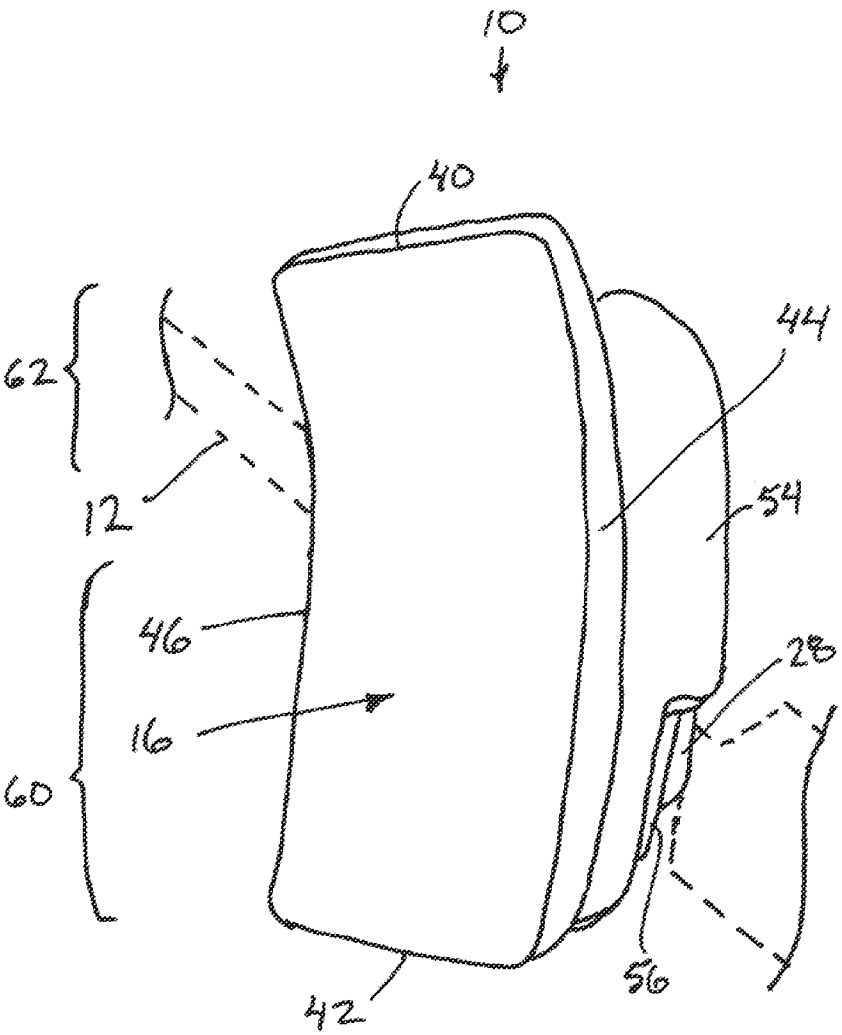
FIG. 1 is a perspective view of a front blocking board of a goalie blocker glove according to the present invention in which a portion of a hockey goalie stick normally held by a right hand of the goalie wearing the goalie blocker glove is also shown in broken line.
Figure 3:
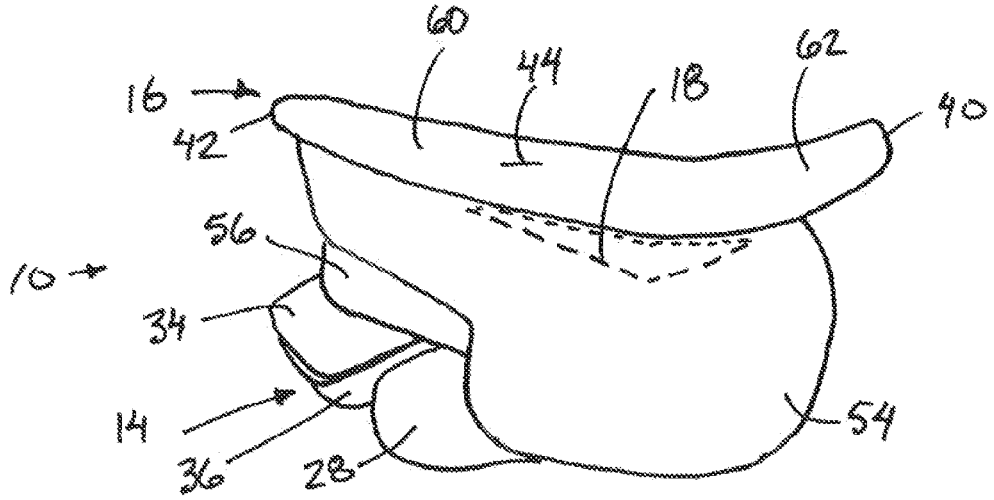
FIG. 3 is a radial side view of the goalie blocker glove according to FIG. 1 in which the ramped insert according to the present invention is represented schematically in broken line.
Figure 4:
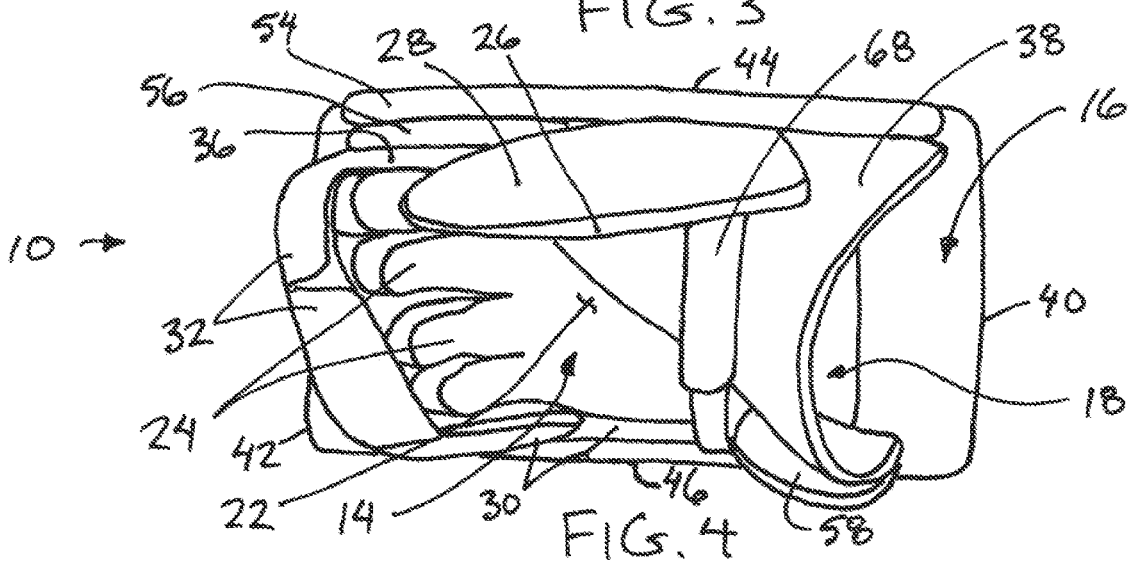
FIG. 4 is a rear elevational view of the goalie blocker glove according to FIG. 1.
Figure 5:
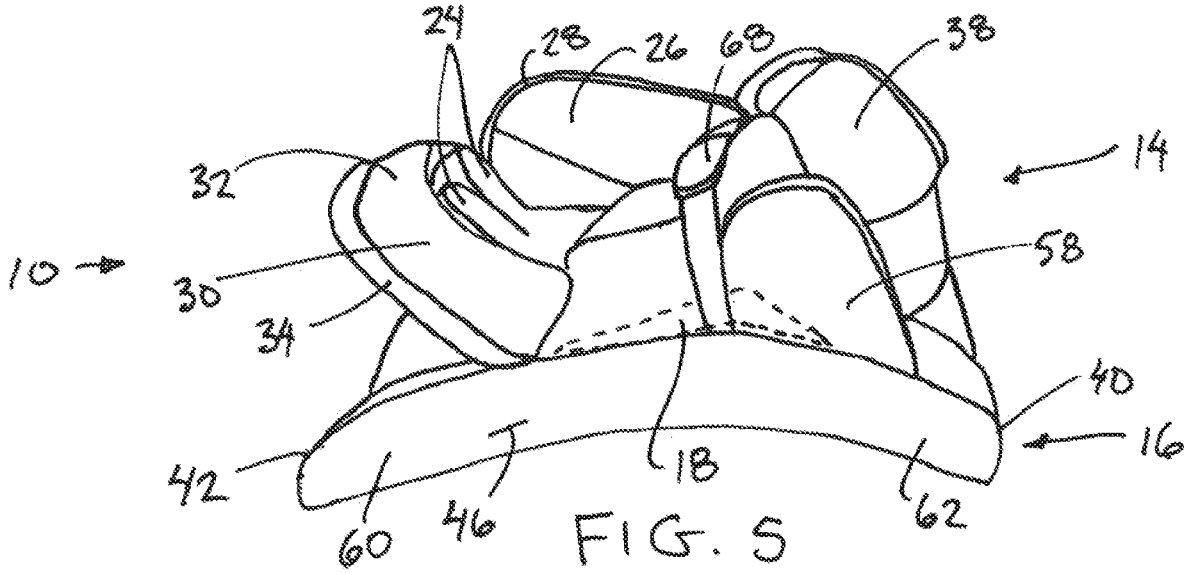
FIG. 5 is an ulnar side view of the goalie blocker glove according to FIG. 1 in which the ramped insert according to the present invention is represented schematically in broken line.
Figure 6:
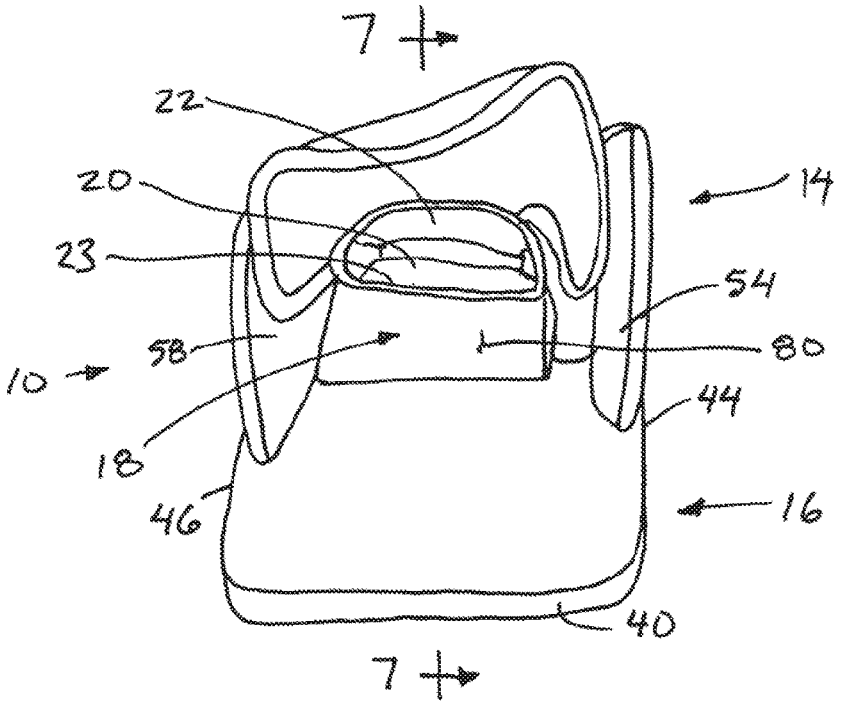
FIG. 6 is a proximal end view of the goalie blocker glove according to FIG. 1.
Figure 7:
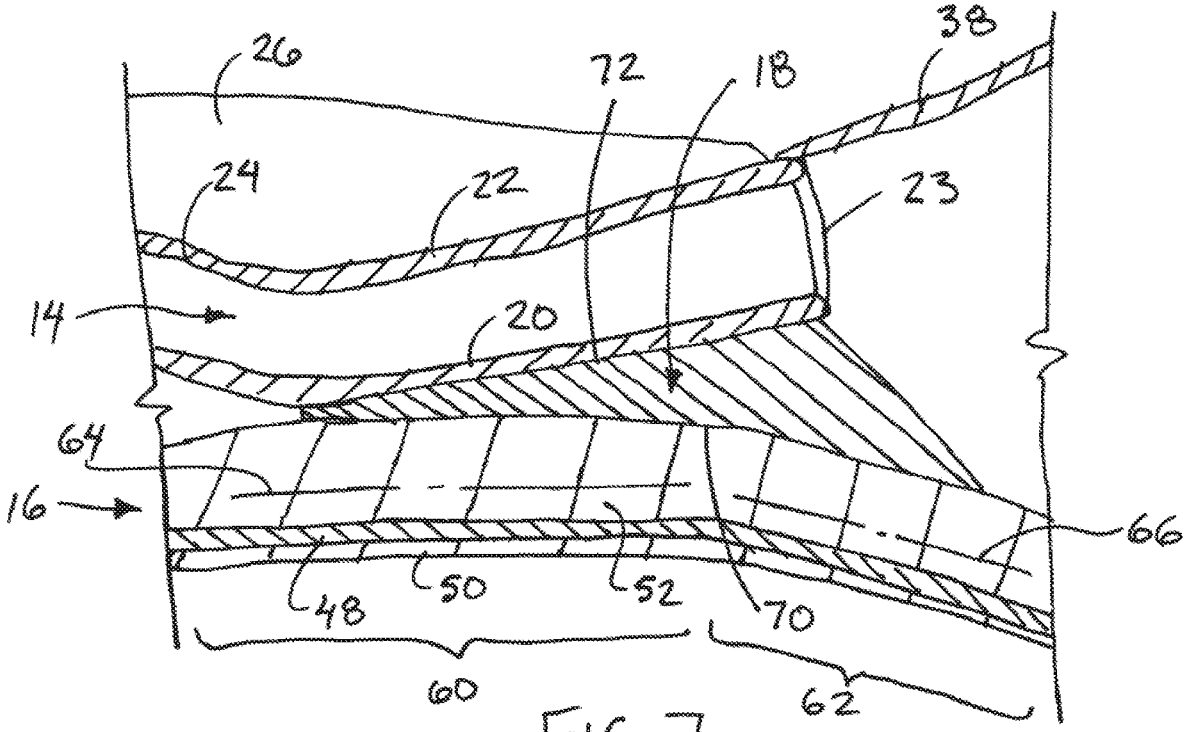
FIG. 7 is a sectional view of a portion of the goalie blocker glove along the line 6-6 in FIG. 7.
Figure 8:
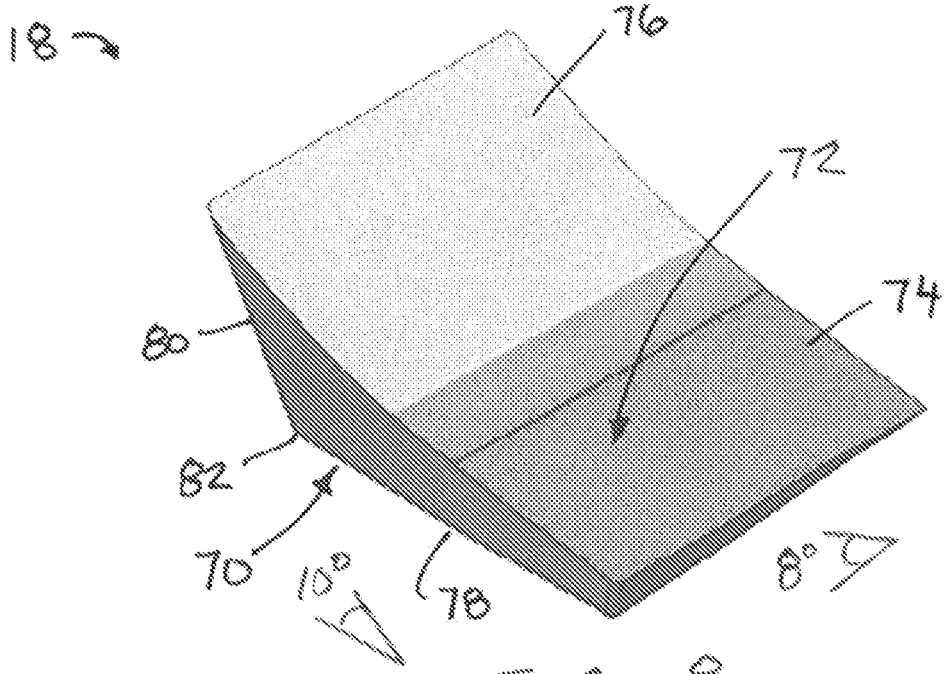
FIG. 8 is a perspective view of the ramped insert shown removed from the goalie blocker glove according to FIG. 1.
Figure 9:
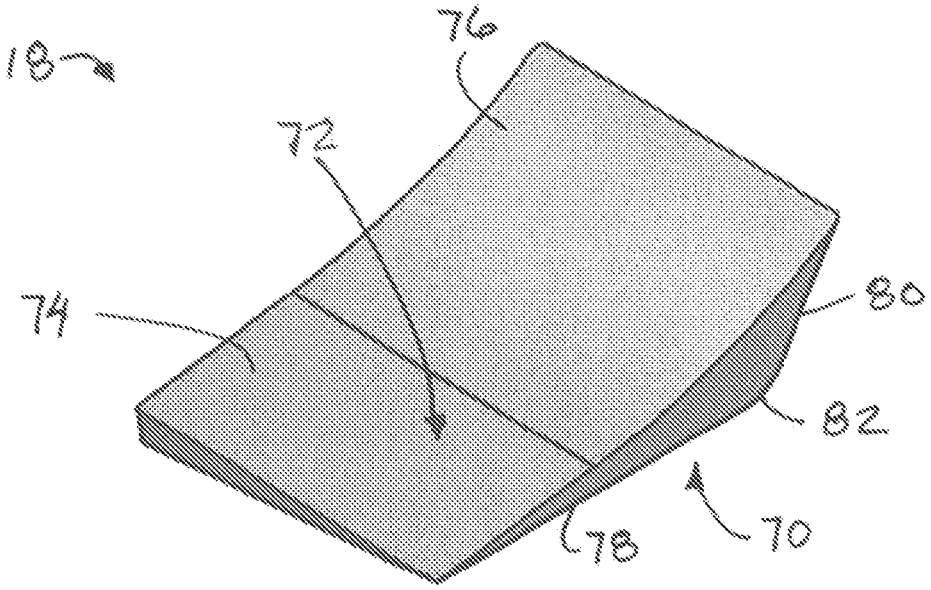
FIG. 9 is another perspective view of the ramped insert of FIG. 8.
Figure 14:
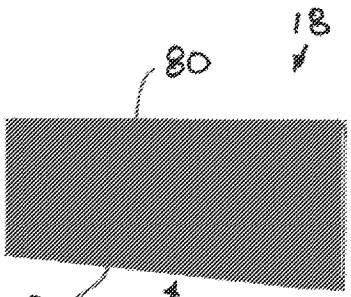
FIG. 14 is an end elevational view of a proximal end of the ramped insert of FIG. 8.
Figure 11:
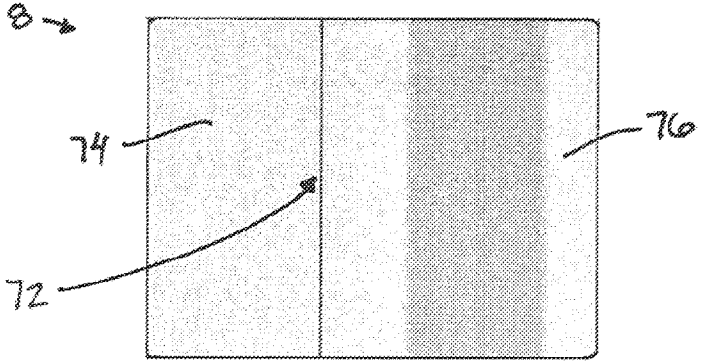
FIG. 11 is a plan view of an exterior side ramped insert of FIG. 8.
Figure 10:
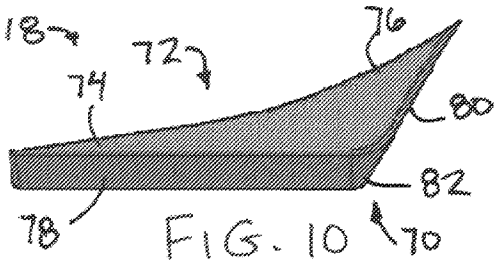
FIG. 10 is a side view of the radial side of the ramped insert of FIG. 8.
Figure 12:
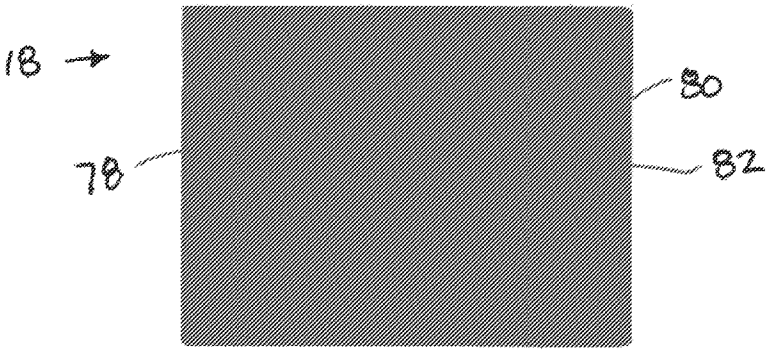
FIG. 12 is a plan view of an interior side ramped insert of FIG. 8.
Figure 13:
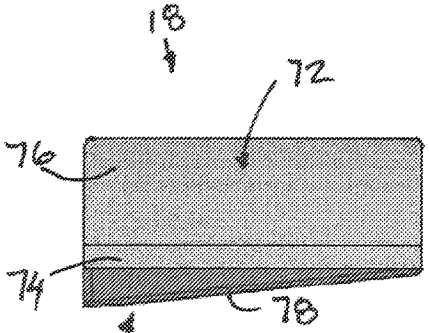
FIG. 13 is an end elevational view of a distal end of the ramped insert of FIG. 8.

Referring to the accompanying figures there is illustrated an ice hockey goalie blocker glove generally indicated by reference numeral 10. In the sport of ice hockey, the blocker glove is intended to be worn on the hand of a goalie that also holds their goalie stick 12 as represented schematically in FIG. 1.

The goalie blocker glove 10 shown in the illustrated embodiment is intended to be worn on the right hand, however, reversing the features of the blocker glove about a symmetrical plane between the radial and ulnar sides of the blocker glove will result in a substantially identical blocker glove that can be worn on the left hand of the user and which has all of the same features and benefits as the right-handed described in the following.

The goalie blocking glove 10 generally includes (i) an inner glove 14 arranged to be worn on the hand of the user at the rear side of the blocker glove 10, (ii) a front blocking board 16 joined to a dorsal side of the inner glove 14 to span a front side of the blocker glove 10, and (iii) a ramped insert 18 comprising a wedge shaped block of material inserted between the front blocking board 16 and the dorsal side of the inner glove 14 to affect the angular orientation of the front blocking board 16 relative to the inner glove 14.

The inner glove 14 comprises a main cavity defined between a dorsal panel 20 at a dorsal side of the inner glove and a palmar panel 22 at the palmar side of the inner glove to receive the palm of the hand therein in use. The main cavity is accessed through a wrist opening 23 at a proximal end of the inner glove for receiving the hand of the user inserted into the inner glove through the wrist opening. At a distal end of the inner glove, a plurality of finger sleeves 24 and a thumb sleeve 26 extend from the inner cavity to receive the fingers and the thumb of the user inserted therein respectively. The thumb sleeve 26 is located at a radial side of the glove for proper alignment with the thumb of the user.

The inner glove 14 is further provided with some protective padding including a thumb pad 28 shielding an outer side of the thumb sleeve 26. A plurality of additional pads are provided about the perimeter of the grouping of finger sleeves 24 including (i) outer side pads 30 extending along the ulnar side of the hand and along the outer side of the smallest fifth digit finger sleeve 24, (ii) distal pads 32 extending across the tips of the finger sleeves 24 at the distal ends thereof, (iii) a dorsal pad 34 spanning the backside of the finger sleeves 24, and (iv) an index pad 36 spanning the inner or radial side of the index finger sleeve 24.

The inner glove 14 also includes a wrist collar 38 connected partway about the wrist opening 23 so as to flare or diverge outwardly as the wrist collar extends longitudinally towards the proximal end of the blocker glove 10 so as to provide protection to the lower forearm adjacent to the wrist without inhibiting flexing movement of the wrist.

The front blocking board 16 is generally rectangular in shape while being elongated in a longitudinal direction from a proximal end 40 of the board to a distal end 42 of the board. A width of the blocker board is defined in a lateral direction between a radial side 44 and an ulnar side 46 of the blocking board.

The blocking board 16 is layered in construction and configuration including an internal rigid layer 48 located towards the exterior side of the blocking board 16 and covered at the exterior side with a finishing material layer 50 such as leather and the like. One or more padding layers 52 are provided at the inner side of the rigid layer 48 including resilient materials like foam, or other suitable impact absorbing materials.

Additional padding to protect the inner glove is provided about the perimeter of the blocking board 16 at the interior side including (i) a main radial pad 54 spanning substantially the full length of the blocking board along the radial side 44 to extend perpendicularly inwardly from the blocking board 16, (ii) a secondary radial pad 56 located inwardly of the main radial pad and in alignment with a cutout in the main radial pad at the radial side of the inner glove in which the secondary radial pad is more flexible than the main radial pad to accommodate gripping a goalie stick with the fingers of the user, and (iii) an ulnar wrist pad 58 protruding perpendicularly inwardly from the blocking board at the ulnar side in alignment with the wrist and lower forearm areas of the blocker glove 10.

The blocking board 16 includes two longitudinally opposed sections which are angularly offset from one another in the form of a primary section 60 and an angled section 62. The primary section 60 occupies a majority of the exterior surface area of the blocking board and is positioned at the distal end to span the full width in the lateral direction from the distal end across a majority of the length to extend beyond a longitudinal centre of the blocking board. The primary section 60 spans the dorsal side of the main cavity and finger sleeves of the inner glove. The primary section 60 which spans the majority of the surface area of the exterior of the blocking board further defines a primary plane 64 of the blocking board.

The angled section 62 of the blocking board occupies less than half of the total surface area at the exterior side of the blocking board and is situated adjacent the proximal end to span the full width in the lateral direction and less than half the length in the longitudinal direction towards the other end of the blocking board. The angled section 62 is primarily situated parallel to an angled plane 66 which is situated at an obtuse exterior angle relative to the primary section 60 which may be within a range of 145 to 180 degrees for example. In the longitudinal direction the angled section 62 is primarily aligned with the wrist and lower forearm of the user.

A wrist strap 68 having an adjustable length extends about the wrist opening 23 of the inner glove and is anchored at opposing ends to the inner side of the blocking board 16 for securely and adjustably strapping the wrist of the user against the front blocking board to assist in retaining the blocker board on the hand of the user in use.

The ramped insert 18 is a block of material inserted between the dorsal panel 20 of the inner glove 14 and an interior surface of the front blocking board 16. The insert 18 is typically formed as a single block of a resilient material. In one example the block is formed by additive manufacturing to comprise an internal lattice structure comprising nodes interconnected by struts in a repeating pattern having a defined strength and flexibility. The open and porous nature of the lattice material throughout the interior volume thereof minimizes the overall weight of the insert.

The ramped insert 18 includes (i) an interior surface 70 primarily located against the inner glove and (ii) an exterior surface 72 primarily located against the interior surface of the front blocking board.

The exterior surface of the insert 18 is generally concave in the longitudinal direction to follow the corresponding shape of the front blocking board as it transitions from the primary section 18 to the angled section 62. In this regard the exterior surface of the insert 18 includes a first surface portion 74 at the distal end of the insert for alignment with the primary section 60 of the blocking board, and a second surface portion 76 situated at the proximal end of the insert for alignment with the angled section 62 of the front blocking board. Accordingly the exterior side of the insert 18 locates the first surface portion 74 and the second surface portion 76 at an obtuse angle relative to one another in a similar range of 145 to 180 degrees to correspond to the angular offset of the angled section 62 relative to the primary section 60 of the front blocking board.

The interior surface 70 also includes longitudinally opposed sections in the form of a distal portion 78 at the distal end for alignment primarily with the dorsal panel of the inner glove, and a proximal end portion 80 at the proximal end for alignment with the angled section 62 of the front blocking board to overlap the wrist and lower forearm of the user towards the proximal end of the blocker glove 10.

The distal portion 78 of the insert 18 occupies the majority of the length of the insert 18 and is tapered to be reduced in thickness in the longitudinal direction towards the distal end from an apex 82 spanning across the width of the insert 18 at an intermediate location along the length thereof. The proximal end portion 80 tapers in the opposing direction so as to be reduced in thickness in the longitudinal direction from the apex 82 towards the proximal end. The maximum thickness of the insert 18 is thus defined at the apex at the intermediate location along the length thereof which is approximately aligned with the wrist opening 23 of the inner glove 14 and/or the wrist strap 68. The longitudinal slope defined by the distal end portion 78 of the insert 18 between the primary plane 64 of the primary section of the front blocking board and the dorsal panel 20 of the inner glove 14 results in a reduction in thickness between interior and exterior surfaces towards the distal end of the blocker glove 10 in which the longitudinal slope is within a range of approximately 5 degrees to 15 degrees, and more preferably is about 10 degrees.

Furthermore, the ramped insert 18 defines a compound angle between the primary plane 64 of the primary section of the front blocking board and the dorsal panel 20 of the inner glove 14 that is also sloped in the lateral direction of the blocker glove 10. In this instance the insert 18 is tapered and reduced in thickness in the lateral direction from the ulnar side 46 towards the radial side 44 of the front blocking board. The lateral slope defined by the distal end portion 78 of the insert 18 between the primary plane 64 of the primary section of the front blocking board and the dorsal panel 20 of the inner glove 14 is within a range of approximately 4 or 5 degrees to 12 degrees, and more preferably is about 8 degrees.

Figure 15A:
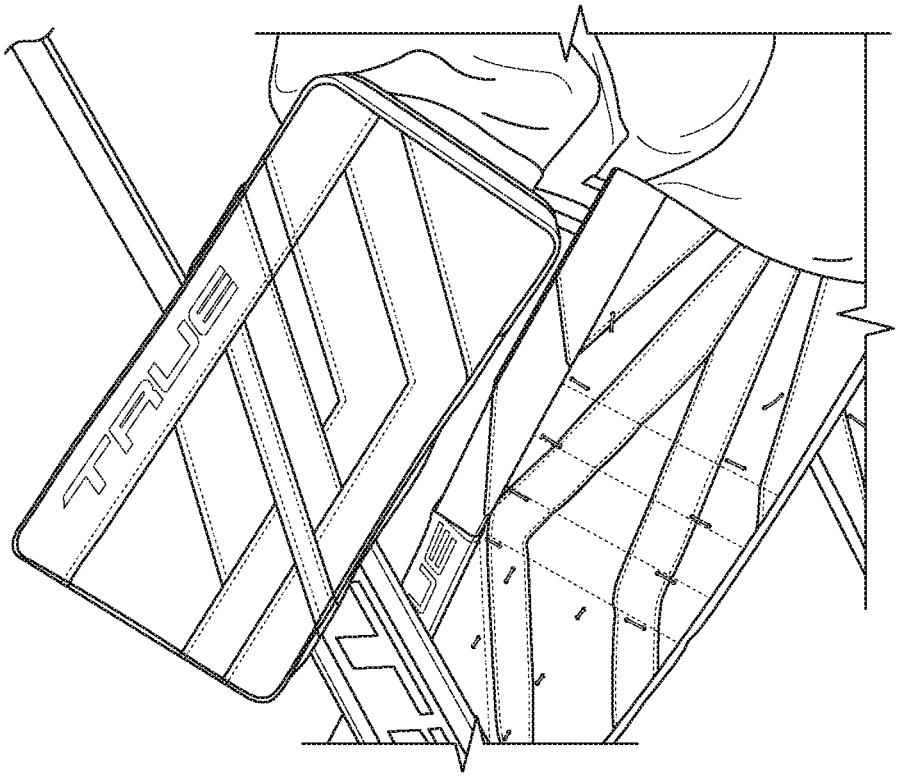
FIGS. 15A and 15B are front elevational views of (i) the goalie blocker glove according to FIG. 1 and (ii) a prior art goalie blocker glove, to illustrate the change in orientation of the front blocking board resulting from the ramped insert.
Figure 15B:
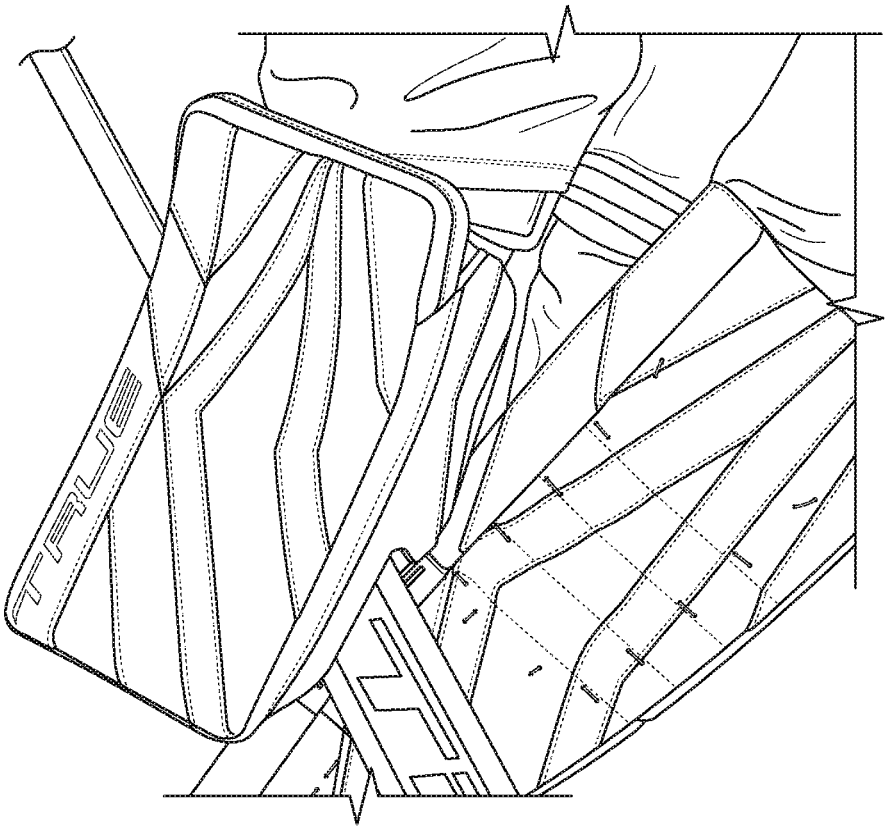

As a result of the compound angle of the ramped insert, the front blocking board is better supported in a perpendicular orientation to the forward direction that the goalie is facing As shown in FIG. 15A, the orientation of the front blocking board more perpendicular to the forward direction of the goalie maximizes the coverage area of the front blocking board as compared to a convention goalie blocker glove in FIG. 15B, when the hand of the goalie grips their hockey stick in the same manner and at the same orientation in each instance.

The proximal end portion 80 is preferably similarly tapered to be reduced in thickness in the lateral direction from the ulnar side to the radial side of the front blocking board within a range of angles similarly to the distal end portion of the insert 18. The proximal end portion 80 is longitudinally tapered towards the proximal end to define the longitudinal slope having an interior angle within a range of 20 to 40 degrees as the proximal end portion 80 extends longitudinally from the wrist opening 23 towards the proximal end of the front blocking board.

In further embodiments, the exterior side of the insert 18 may be varied in shape to accommodate different shapes of front blocking boards; however, in each instance the insert 18 defines a similar longitudinal slope between the primary plane of the blocking board and the dorsal panel of the inner glove at the distal end of the insert 18.

In further embodiments, the insert 18 may also be configured so as to be sloped only in the longitudinal direction, or sloped only in the lateral direction rather than defining a compound angle of both lateral and longitudinal slopes.

In further embodiments, the material and construction of the ramped insert 18 may also be varied in configuration while still supporting the front blocking board relative to the inner glove at a desirable longitudinal slope, lateral slope, or combination thereof.

Since various modifications can be made in the invention as herein above described, and many apparently widely different embodiments of same made, it is intended that all matter contained in the accompanying specification shall be interpreted as illustrative only and not in a limiting sense.

The invention claimed is:

1. A goalie blocking glove comprising:

an inner glove to receive a hand of a user therein and including a dorsal panel for spanning a dorsal side of the hand;

a front blocking board coupled to the inner glove to protect the dorsal side of the hand, the front blocking board being elongated in length in a longitudinal direction and having a width transverse to the length in a lateral direction, and the front blocking board including a primary board section occupying a majority of front blocking board and defining a primary plane of the front blocking board;

a ramped insert having a wedged shape, the ramped insert being supported between the dorsal panel of the inner glove and the front blocking board such that the primary plane of the front blocking board is non-parallel to the dorsal panel;

wherein the ramped insert forms the wedged shape in the lateral direction and increases in thickness in the lateral direction from a radial side to an ulnar side of the inner glove.

2. The goalie blocking glove according to claim 1 wherein an exterior surface of the ramped insert adjacent the front blocking board is sloped in the lateral direction relative to an interior surface of the ramped insert adjacent the inner glove at an angle in the range of 4 degrees to 12 degrees.

3. The goalie blocking glove according to claim 1 wherein the ramped insert further increases in thickness in the longitudinal direction from a distal end to a proximal end of the inner glove.

4. The goalie blocking glove according to claim 3 wherein the exterior surface of the ramped insert adjacent the front blocking board is sloped in the longitudinal direction relative to the interior surface of the ramped insert adjacent the inner glove at an angle in the range of 5 degrees to 15 degrees.

5. The goalie blocking glove according to claim 4 wherein the ramped insert includes a proximal end portion which is longitudinally tapered towards a proximal end of the front blocking board.

6. The goalie blocking glove according to claim 1 wherein the front blocking board includes an angled board section at a proximal end of the front blocking board which is angularly offset from the primary board section at the distal end of the front blocking board, the exterior surface of the ramped insert including first and second surface portions which are angularly offset from one another such that the first and second surface portions align with the primary board section and the angled board section respectively.

7. The goalie blocking glove according to claim 1 wherein the ramped insert is formed of a resilient material.

8. A goalie blocking glove comprising:

an inner glove to receive a hand of a user therein and including a dorsal panel for spanning a dorsal side of the hand;

a front blocking board coupled to the inner glove to protect the dorsal side of the hand, the front blocking board being elongated in length in a longitudinal direction and having a width transverse to the length in a lateral direction, and the front blocking board including a primary board section occupying a majority of front blocking board and defining a primary plane of the front blocking board; and a ramped insert having a wedged shape, the ramped insert being supported between the dorsal panel of the inner glove and the front blocking board such that the primary plane of the front blocking board is non-parallel to the dorsal panel;

wherein an exterior surface of the ramped insert adjacent the front blocking board is sloped relative to an interior surface of the ramped insert adjacent the inner glove at a compound angle comprising both (i) a lateral slope in which the ramped insert increases in thickness in the lateral direction from a radial side to an ulnar side of the inner glove and (ii) a longitudinal slope in which the ramped insert increases in thickness in the longitudinal direction from a distal end to a proximal end of the inner glove.

9. The goalie blocking glove according to claim 8 wherein the exterior surface of the ramped insert adjacent the front blocking board is sloped in the lateral direction relative to the interior surface of the ramped insert adjacent the inner glove at an angle in the range of 4 degrees to 12 degrees and wherein the exterior surface of the ramped insert adjacent the front blocking board is sloped in the longitudinal direction relative to the interior surface of the ramped insert adjacent the inner glove at an angle in the range of 5 degrees to 15 degrees.

10. The goalie blocking glove according to claim 8 wherein the front blocking board includes an angled board section at a proximal end of the front blocking board which is angularly offset from the primary board section at the distal end of the front blocking board, the exterior surface of the ramped insert including first and second surface portions which are angularly offset from one another such that the first and second surface portions align with the primary board section and the angled board section respectively.

11. The goalie blocking glove according to claim 8 wherein the ramped insert is formed of a resilient material.

* * * * *